US007735297B2

(12) United States Patent
Monti

(10) Patent No.: US 7,735,297 B2
(45) Date of Patent: Jun. 15, 2010

(54) APPARATUS FOR CAPPING BOTTLES AND A METHOD FOR REALISING THE CAP

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 95 days.

(21) Appl. No.: 11/971,260

(22) Filed: Jan. 9, 2008

(65) Prior Publication Data

US 2008/0178561 A1 Jul. 31, 2008

(30) Foreign Application Priority Data

Jan. 25, 2007 (IT) ..... BO2007A0044

(51) Int. Cl.
*B65B 7/28* (2006.01)

(52) U.S. Cl. ..... 53/329; 53/286; 53/489; 53/543

(58) Field of Classification Search ..... 53/329, 53/543, 202, 150, 286, 287, 489, 141, 295
See application file for complete search history.

(56) References Cited

U.S. PATENT DOCUMENTS

| | | | | |
|---|---|---|---|---|
| 3,559,563 | A * | 2/1971 | Brenner et al. | 99/275 |
| 3,855,749 | A | 12/1974 | McMickle | |
| 4,947,627 | A * | 8/1990 | Scheidegger | 53/557 |
| 5,493,849 | A | 2/1996 | Itoh | |
| 5,858,141 | A * | 1/1999 | Repp et al. | 156/69 |
| 6,393,800 | B1 | 5/2002 | Schwenke | |
| 6,578,614 | B1 * | 6/2003 | Loewenthal | 156/358 |

FOREIGN PATENT DOCUMENTS

| | | |
|---|---|---|
| EP | 0 188 153 A | 7/1986 |
| EP | 0 488 901 A | 6/1992 |

* cited by examiner

*Primary Examiner*—Sameh H. Tawfik
(74) *Attorney, Agent, or Firm*—William J. Sapone; Coleman Sudol Sapone P.C.

(57) ABSTRACT

An apparatus for capping bottles, comprising: gripping devices for bottles containing products, constrained to a transporter, each of which gripping devices exhibits on a side thereof a gripping means of a corresponding bottle, and on an opposite side thereof hooking-receiving-stabilizing organ of a cap; at least a channel for supplying caps, arranged superiorly of the transporter upstream of a capping zone overlying the hooking-receiving-stabilizing organs transiting below the channel, into which a row of caps is conveyed, a head cap of the row of caps being held elastically by a lower end of the supply channel in order to position an internal surface of a relative head such as to intercept a front head (96*a*) of an underlying hooking-receiving-stabilizing organ in order to enable the head cap, in combination with the advancing of the transporter and with the striking and guiding action exerted by the supply channel, to disengage from the supply channel in order to locate in the corresponding hooking-receiving-stabilizing organ, with the relative body facing downwards; at least a pick-up organ, located in the capping zone, operating in phase relation with a corresponding hooking-receiving-stabilizing organ, with the body thereof facing downwards; at least a pick-up organ destined to hook and extract the cap present therein, and to position the cap axially in an inlet mouth of the corresponding bottle supported by the gripping device flanking the hooking-receiving-stabilizing organ, in order to perform insertion of the body of the cap in the mouth of the bottle in order to close the bottle.

6 Claims, 4 Drawing Sheets

APPARATUS FOR CAPPING BOTTLES AND A METHOD FOR REALISING THE CAP

BACKGROUND OF THE INVENTION

The invention relates to the technical sector of capping apparatus for bottles.

The prior art describes bottles which are hooked by gripping means, associated to a transporter which enables the advancing of the bottles from a filling station, in which they are filled with products, for example liquids, granular and/or powder materials, towards a station in which capping apparatus are provided.

A known capping apparatus is constituted by: supply channels, arranged inclined transversally to the advancement direction of the transporter and, therefore, to the bottles, to each of which caps are conveyed to identify a row, where the leading cap strikes against a striker such as to stabilize a position thereof above an extractor, with the body of the cap facing upwards; a receiving and positioning arm, hinged at an end thereof to a base and exhibiting at another end thereof a through-hole for receiving.

The receiving and positioning arm takes on: a receiving position, in which the hole is axial with the head cap of the row of caps and with the extractor that when activated enables insertion of the body of the leading cap into the hole in the end of the arm; an expulsion position, in which the arm, rotated by 180°, brings the cap to above the inlet mouth of the bottle, with the body of the cap facing downwards, coaxially thereto; known pusher organs, also axial with the inlet mouth of the bottle, push the cap downwards, disengaging it from the end of the arm and inserting it in the mouth of the bottle to close it.

With the transporter step-activated, "n" bottles (for example two, three, four bottles) are contemporaneously operated-on; this leads to contemporary capping of one or more bottles.

To cap a group of n bottles there must be n supply channels, n receiving and positioning arms and the same number of extractor organs and pusher organs, with all the drawbacks that derive from the functional complexity of the apparatus and the maintenance of the cap positioning and bottle closing devices.

The above-described capping apparatus exhibits drawbacks deriving from the number of bottles to be capped: for each bottle to be capped a supply channel, a receiving and positioning arm and corresponding extractor and pusher organs must be included.

SUMMARY OF THE INVENTION

For transporters which enable capping n bottles, the aim of the present invention is to provide a capping apparatus for bottles which includes a single supply channel.

A further aim of the invention is to provide a bottle capping apparatus which requires no intervention thereon when the operating step of the machine it is installed on is changed.

A still further aim of the invention is to provide a capping apparatus which is realized such as to include organs, associated to means for gripping the bottles, which hook, receive and insert the closing cap before insertion thereof in the bottle.

A further aim of the invention is to provide a capping apparatus for bottles which is realized such as to include a single device for collecting the caps and positioning them in the corresponding bottles, which device is sized on the basis of the operative step of the machine, i.e. the number of bottles on which contemporaneous intervention for capping the bottles is to be made.

A still further aim of the bottle capping apparatus is the adaptability of the devices it is constituted by both in machines working intermittently and in machines working continuously.

A further aim of the invention is to provide a method for capping bottles which is new, simple and original, and which can be actuated by operative stages which are very simple to realize, as well as being adaptable to continuously-working or step-working machines.

The above-indicated aims are all obtained by the present invention, as will emerge from the contents of the claims.

The invention provides an apparatus for capping bottles, comprising: gripping devices for bottles containing products, constrained to a transporter, each of which gripping devices exhibits on a side thereof a gripping means of a corresponding bottle, and on an opposite side thereof a hooking-receiving-stabilizing organ of a cap; at least a channel for supplying caps arranged superiorly of the transporter, upstream of a capping zone, and overlying the hooking-receiving-stabilizing organs transiting below the channel, into which at least a channel a row of caps is conveyed, cylindrical bodies of which face towards an upstream end of the transporter, with a head cap of the row of caps being held elastically by a lower end of the supply channel in order to position an internal surface of a relative head such as to intercept a front head of an underlying hooking-receiving-stabilizing organ in order to enable the head cap, in combination with the advancing of the transporter and with the striking and guiding action exerted by the supply channel, to disengage from the supply channel in order to locate in the corresponding hooking-receiving-stabilizing organ, with the relative body facing downwards; at least a pick-up organ, located in the capping zone, operating in phase relation with a corresponding hooking-receiving-stabilizing organ, the at least a pick-up organ being destined to hook and extract the cap present therein, and to position the cap axially in an inlet mouth of the corresponding bottle supported by the gripping device flanking the hooking-receiving-stabilizing organ, in order to perform insertion of the body of the cap in the mouth of the bottle in order to close the bottle.

BRIEF DESCRIPTION OF THE DRAWINGS

The characteristics of the invention are illustrated with reference to the appended figures of the drawings, in which.

DESCRIPTION OF THE PREFERRED EMBODIMENTS

With reference to the figures of the drawings, T denotes a transporter to which gripping devices 9 for the bottles F containing products, for example liquids, granular and/or powder products, are externally blocked according to an interaxis d.

Figure 2:
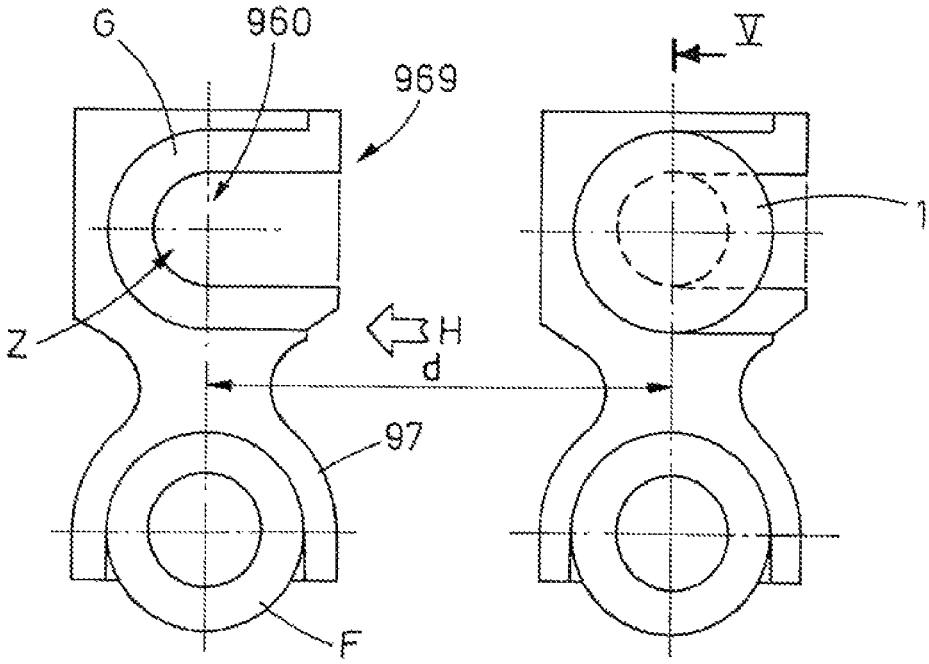
FIG. 2 is a view from above of the bottle gripping means to which cap hooking, receiving and stabilizing organs are associated.
Figure 5B:
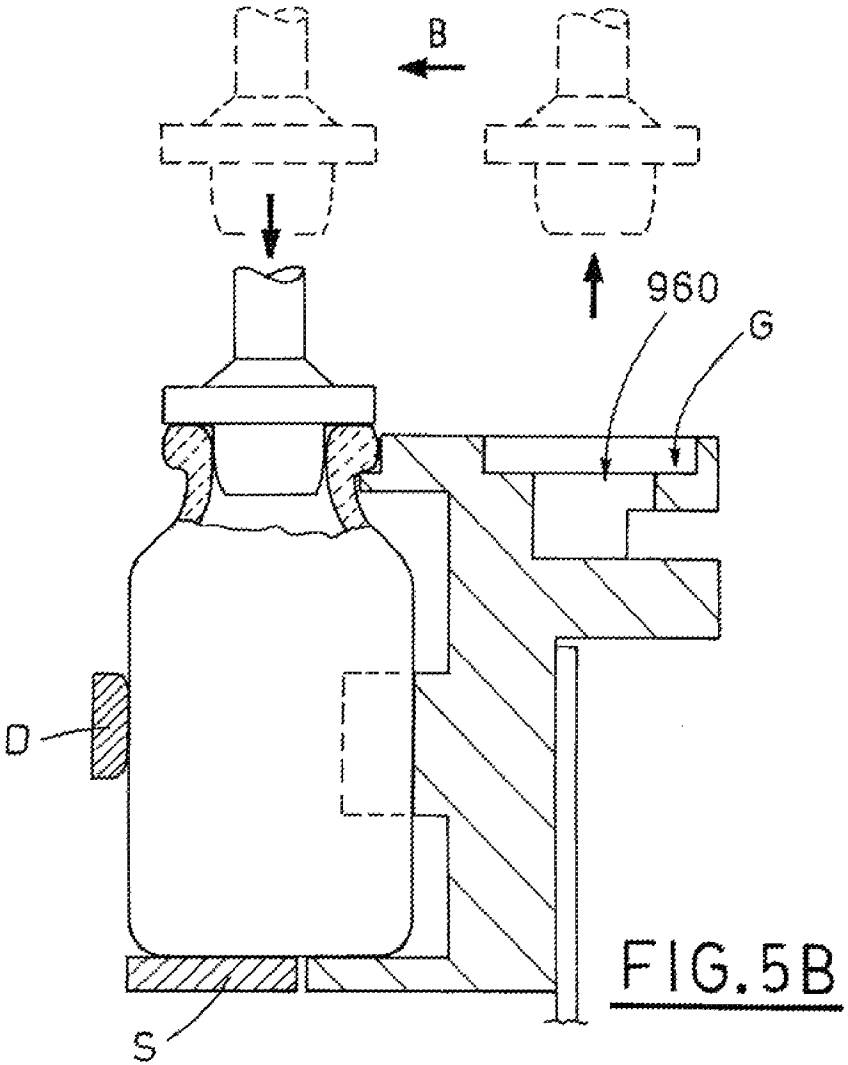
FIGS. 5A, 5B are views of section V-V of FIG. 2, in different operative stages.
Figure 5A:
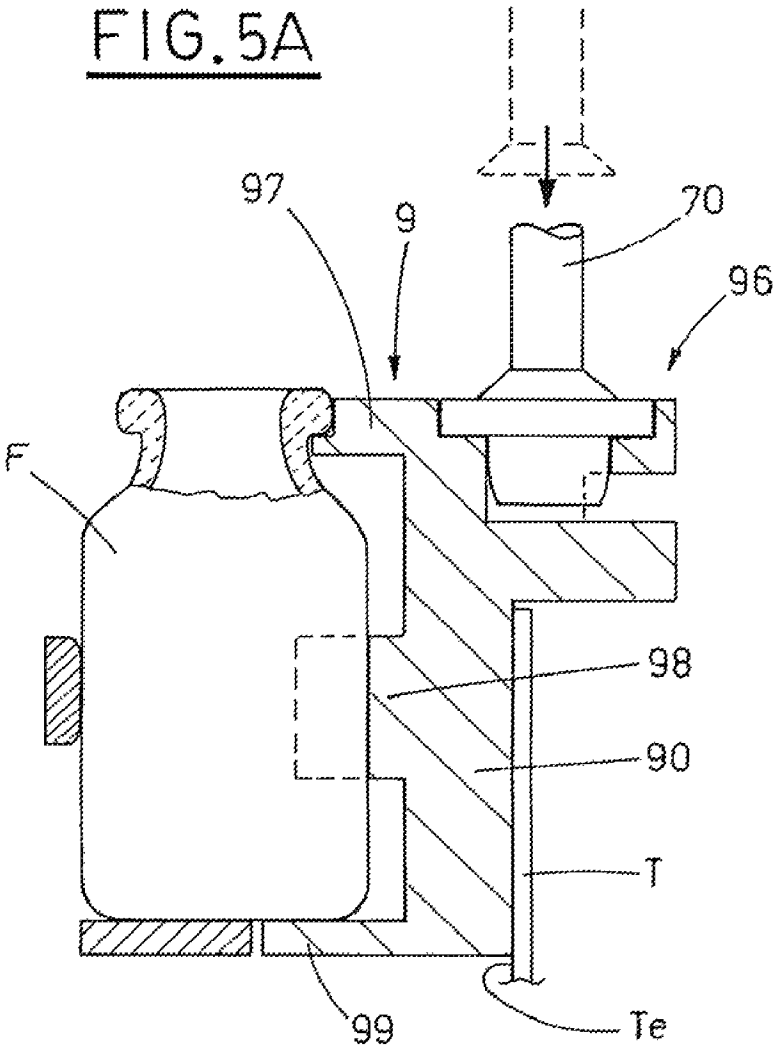

Each gripping device 9, as illustrated in FIGS. 2, 5A, 5B is constituted, for example (see EP 0626770.4 belonging to the present applicant) by: a vertical portion 90, constrained to the external part Te of the transporter T; a support base 99, which extends external-wise perpendicularly from the vertical portion 90, on which the bottom of a bottle F partially rests; an intermediate striker 98 for the bottle F, parallel to the support base 99 which partially embraces the bottle F; a sort of pliers 97, which extend towards the outside of the transporter T, perpendicularly from the vertical portion 90, to which the neck of the bottle F is hooked.

To guide the bottles F hooked to the gripping devices 9, as illustrated in FIGS. 5A, 5B, a lateral guide wall D is provided, which runs parallel to the active branch of the transporter T, laterally meeting the bottles; in the capping zone there is also a fixed support S which flanks the support base 99 of each gripping device 9 and cooperates therewith to support the bottles F during the capping operation.

Each bottle gripping device 9, on the opposite side of the pliers 97, exhibits a hooking-receiving-stabilizing organ 96 for a corresponding cap 1 of the type constituted by a cylindrical body 100 and a cylindrical head 10.

The hooking-receiving-stabilizing organ 96 affords a housing 960 (FIG. 2) which is accessible from above and frontally, in a direction going from downstream towards upstream (arrow H of FIG. 2) through an opening 969.

The edge delimiting the housing 960 is shaped such as to identify, towards the inside, a step G, constituted by two straight counter-facing tracts connected by a semi-circular tract; it follows that, as shown herein below, the profile Z of the housing 960 meets the body 100 of the cap, with the head 10 of the cap itself meeting the base of the step G.

A cap supply channel 8 is located superiorly of the transporter T and upstream of the capping zone, which cap supply channel 8 perpendicularly overlies the hooking-receiving-stabilizing organs 96 transiting there-below.

Figure 1:
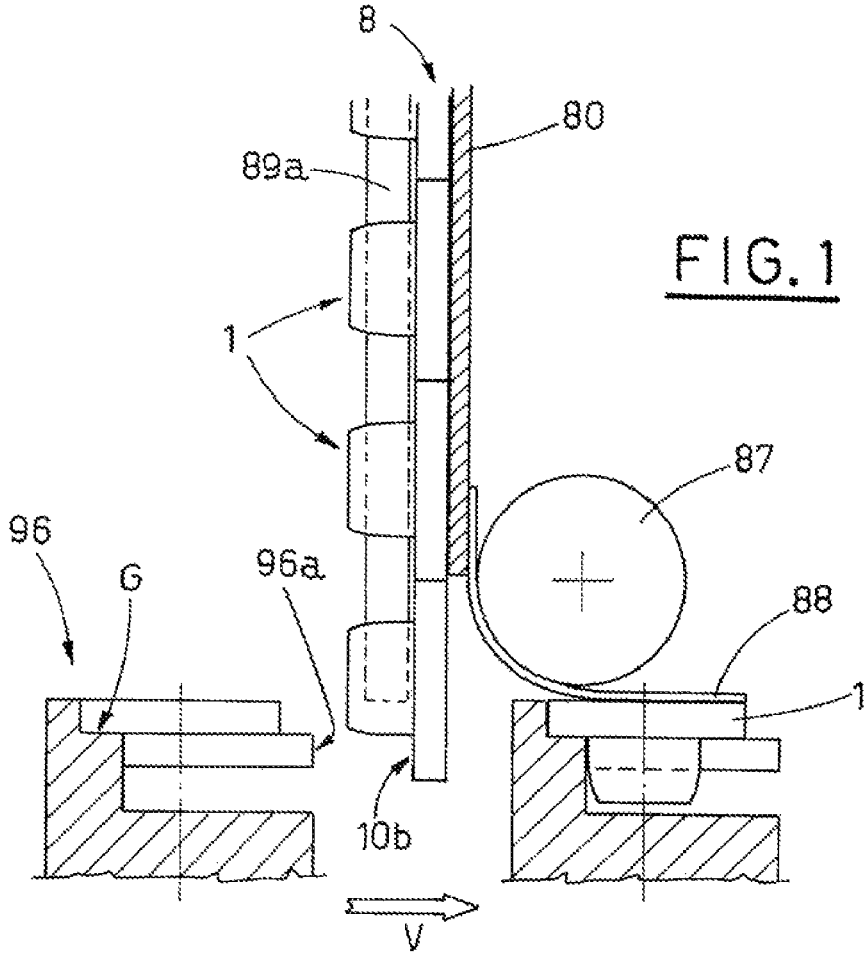
FIG. 1 is a lateral view of a vertical section of the cap supply in a bottle capping apparatus, object of the present invention.

The cap supply channel 8 is defined by: a vertical wall 80; two vertical list-shaped elements 89*a*, 89*b*, located upstream of the vertical wall 80 at a distance of no less than the thickness of the head 10 of the caps 1, lower ends 890 of which list-shaped elements 89*a*, 89*b* are bent inwards to define an elastic abutment (FIG. 4); a curved sheet 88, anchored to the lower end of the external surface 800 of the vertical wall 80, contrasted by an idle wheel 87, as illustrated in FIG. 1.

Figure 7:
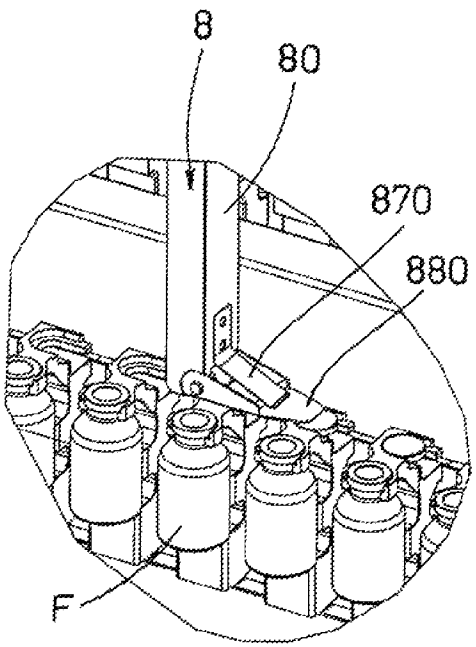
FIG. 7 is a reduced-scale perspective view of detail X of FIG. 6, in the direction of the arrow K.
Figure 6:
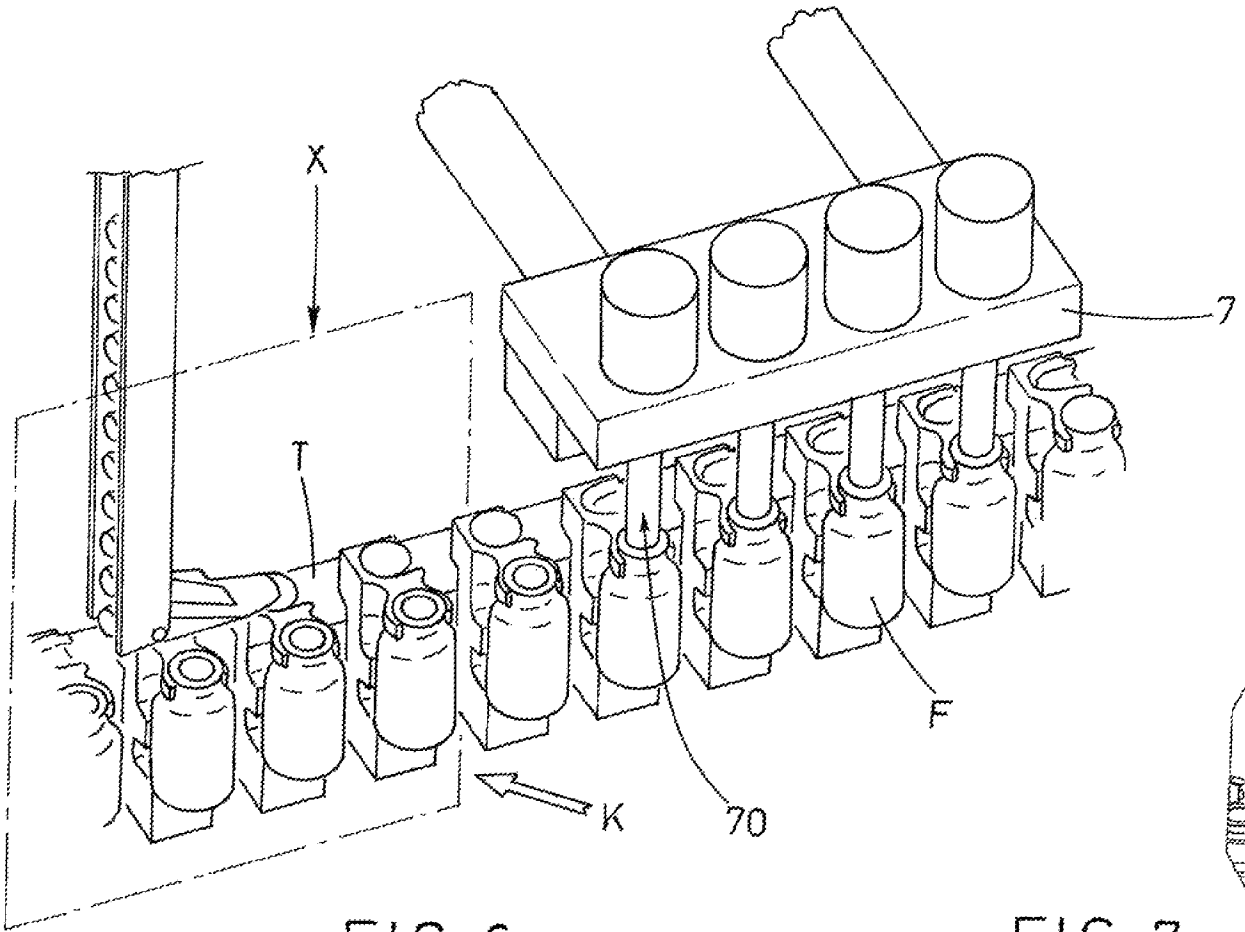
FIG. 6 is a perspective view of the bottle capping apparatus of the present invention.

In a variant illustrated in FIGS. 6, 7, the sheet 88 is replaced by a small plate 880 hinged to the lower end of the supply channel 8 and facing downstream, and by a tongue 870 fixed to an end of the vertical wall 80 of the supply channel 8 and with the other end meeting the upper surface of the small plate 880 to keep the plate 880 substantially perpendicular with respect to the supply channel 8.

A line of caps 1 is brought, using known techniques, into the supply channel 8, such that the external surfaces 10*a* of the heads 10 of the caps 1 contact against the upstream surface of the vertical wall 80, the cylindrical bodies 100 of the caps are facing towards the upstream end of the transporter T, and the opposite surfaces of the vertical list-shaped elements 89*a*, 89*b*, meet the cylindrical body 100 of the caps 1 to guide them into the supply channel 8.

The head cap 11 is held back by the elastic abutment at the lower ends 890 of the vertical list-shaped elements 89*a*, 89*b*.

Figure 3A:
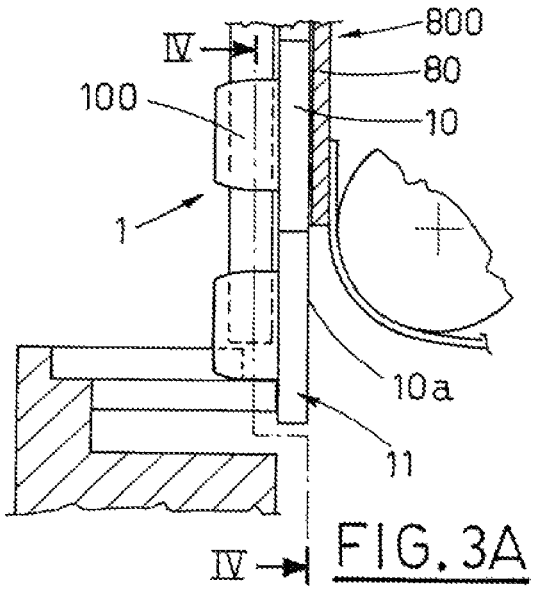
FIGS. 3A, 3B, 3C are consecutive views of the operating stages of cap hooking, receiving and stabilizing.
Figure 4:
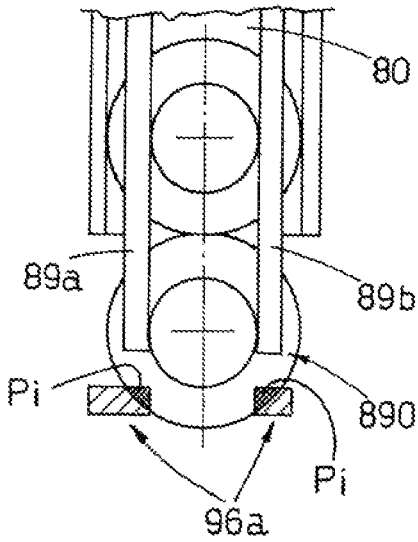
FIG. 4 is a view of section IV-IV of FIG. 3A.

As the transporter T advances in the advancement direction V of FIG. 1, the front head 96*a* of the hooking-receiving-stabilizing organ 96, upstream of the supply channel 8, intercepts the internal surface 10*b* of the head 10 of the head cap 11 at least in a portion Pi (FIG. 3A, 4).

Figure 3B:
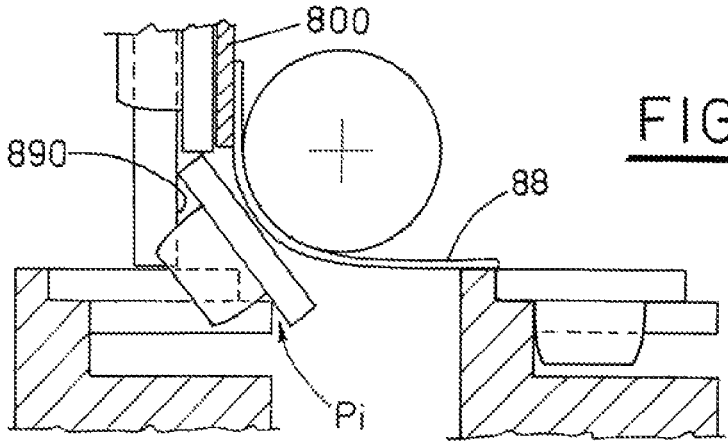
Figure 3C:
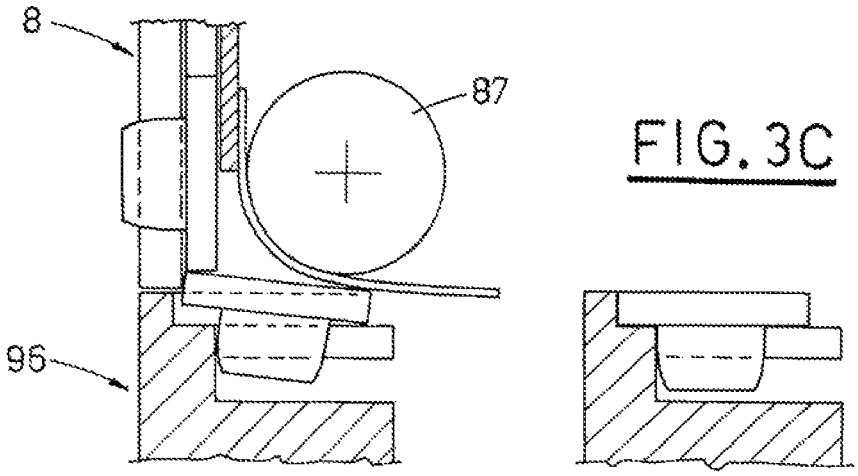

The interception, in combination with the advancing of the transporter and due to the combined striking action of the sheet 88 and the list-shaped elements 89*a*, 89*b* (see FIG. 3*b*), causes a gradual oscillation towards upstream of the cap 11 (more precisely, anticlockwise with reference to FIGS. 3A, 3C) up to the insertion of the body 100 in the housing 960, which body 100 is consequently orientated downwards, and the encountering of the head 10 against the base of the step G (FIG. 3*c*).

With the advancing of the transporter T, the cap, due to inertia, tends to move upstream, which stabilizes the position thereof in the hooking-receiving-stabilizing organ 96.

With the activating of the step transporter, with an operating step which is n times the interaxis d, as described herein above (for example the advancing of four bottles, as illustrated in FIG. 6), the positioning of the caps is performed, as previously described, in a same number n of hooking-receiving-stabilizing organs 96.

Following the positioning of the caps in the corresponding hooking-receiving-stabilizing organs 96 and the advancing of the transporter T, known pick-up organs 70 of a manipulator 7 (FIG. 6), located downstream of the supply channel 8 axially of the hooking-receiving-stabilizing organs 96, lower to hook the caps 1 present in the hooking-receiving-stabilizing organs 96, and extract the caps 1 therefrom, raising them vertically.

The pick-up organs 70 then translate transversally in the direction of the arrow B of FIG. 5B, in order to position the caps superiorly, axially of the inlet mouths of the corresponding bottles supported by the gripping devices 9, then to lower and cause the insertion of the bodies 100 of the caps 1 in the mouths of the bottles F to close the bottles F; during this stage the support S contrasts the force, which is a downwards force, exerted on the bottle by the pick-up organ 70.

The described bottle capping apparatus is particularly advantageous, as differently to known capping apparatus, the insertion of the caps in the mouths of the bottles is simplified.

The conformation of the hooking-receiving-stabilizing organs 96 and the positioning of the supply channel 8 with respect to the hooking-receiving-stabilizing organs 96 transiting below it, during the advancing of the transporter T, enables each organ 96 to hook, receive and stabilize a corresponding cap picked up from the supply channel 8, as previously described.

The positioning of the supply channel 8 with respect to the hooking-receiving-stabilizing organs 96 is advantageous; with a single supply channel it is possible to position caps 1 on the hooking-receiving-stabilizing organs 96 transiting below the channel.

The fact that the gripping devices 9 of the bottles F exhibit, on the opposite side of the pliers 97, the hooking-receiving-stabilizing organs 96 is advantageous, as following the positioning of the caps in the hooking-receiving-stabilizing organs 96 and the advancing of the transporter T into the capping zone, it is possible by means of the picking up and manipulating organs, a size of which is based on the operating step of the machine in which the capping apparatus is located, to pick up the caps from the hooking-receiving-stabilizing organs 96, and to insert the bodies 100 of the caps in the mouths of the bottles.

The conformation of the hooking-receiving-stabilizing organs 96 and the positioning of the supply channel 8 lend further versatility to the capping apparatus; if the operating step of the machine is d, 2d, . . . , nd, it is sufficient to include on the manipulator an equal number of pick-up organs 70 which enable picking up and insertion of the bodies of the caps in the mouths of the corresponding bottles.

Further, by acting on the movement of the manipulator the apparatus can also be suited to continuously-operating machines.

The preceding description is by way of example and has a non-limiting value; all modifications considered necessary for production and/or functional needs can be brought to the invention, all falling within the ambit defined in the claims appended hereto.

What is claimed:

1. An apparatus for capping bottles comprising:

gripping devices for bottles containing products, constrained to a transporter, each of which gripping devices exhibits on a side thereof a gripping means for a corresponding bottle, the gripping means constituted by a vertical portion constrained to an external part of the transporter and a pliers portion which extend towards an outside of the transporter, perpendicular from the vertical portion to which a neck of the bottle is hooked, and on an opposite side of the pliers portion there is provided a hooking-receiving-stabilizing organ for a cap; at least one vertical channel for supplying caps arranged superiorly of the transporter, upstream of a capping zone, and overlying the hooking-receiving-stabilizing organs transiting below the channel, a row of caps being conveyed into the at least one vertical channel, cylindrical bodies of which face towards an upstream end of the transporter, with a head cap of the row of caps being held elastically by a lower end of the supply channel in order to position an internal surface of a relative head such as to intercept a front head of an underlying hooking-receiving-stabilizing organ in order to enable the head cap, in combination with an advancing of the transporter and with a striking and guiding action exerted by the supply channel, to disengage from the supply channel in order to locate in the corresponding hooking-receiving-stabilizing organ, with the relative body facing downwards; at least one pick-up organ, located in the capping zone, operating in phase relation with a corresponding hooking-receiving-stabilizing organ, the at least one pick-up organ being destined to hook and extract the cap present therein, and to position the cap axially in an inlet mouth of the corresponding bottle supported by the gripping device flanking the hooking-receiving-stabilizing organ, in order to perform insertion of the body of the cap in a mouth of the bottle in order to close the bottle.

2. The apparatus of claim 1, characterized in that the hooking-receiving-stabilizing organ exhibits a housing, accessible from above and frontally, in a direction going from downstream to upstream, through an opening, with an edge thereof which delimits the housing being shaped such as to identify a step towards an inside thereof, the step being constituted by two straight opposite tracts connected by a semicircular tract, a profile thereof meeting the body of the cap, a base of the step meeting a head of the cap.

3. The apparatus of claim 1, characterized in that the cap supply channel perpendicularly overlies the hooking-receiving-stabilizing organs.

4. The apparatus of claim 1 further comprising a support, located in the capping zone, which flanks a support base provided in each gripping device (9) for cooperating with the pick-up organ in order to enable a correct insertion of the body of the cap in the mouth of a corresponding bottle.

5. The apparatus of claim 1, characterized in that the pick-up organs are equal in number to the gripping devices comprised in the operating step of the machine to which the capping apparatus is associated.

6. An apparatus for capping bottles comprising: gripping devices for bottles containing products, constrained to a transporter, each of which gripping devices exhibits on a side thereof a gripping means for a corresponding bottle, and on an opposite side thereof a hooking-receiving-stabilizing organs for a cap; at least one channel for supplying cars arranged superiorly of the transporter, upstream of a capping zone, and overlying the hooking-receiving-stabilizing organs transiting below the channel, a row of caps being conveyed into the at least one channel, cylindrical bodies of which face towards an upstream end of the transporter, with a head cap of the row of caps being held elastically by a lower end of the supply channel in order to position an internal surface of a relative head such as to intercept a front head of an underlying hooking-receiving-stabilizing organ in order to enable the head cap, in combination with an advancing of the transporter and with a striking and guiding action exerted by the supply channel, to disengage from the supply channel in order to locate in the corresponding hooking-receiving-stabilizing organ, with the relative body facing downwards; at least one pick-up organ, located in the capping zone, operating in phase relation with a corresponding hooking-receiving-stabilizing organ, the at least one pick-up organ being destined to hook and extract the cap present therein, and to position the cap axially in an inlet mouth of the corresponding bottle supported by the gripping device flanking the hooking-receiving-stabilizing organ, in order to perform insertion of the body of the cap in a mouth of the bottle in order to close the bottle, the cap supply channel perpendicularly overlying the hooking-receiving-stabilizing organs, the cap supply channel being defined by: a vertical wall; two vertical profiles, located upstream of the vertical wall at a distance therefrom of not less than a thickness of the head of the caps, lower ends of which vertical profiles are bent internal-wise to define an elastic abutment which holds back the head cap; a curved sheet, anchored to the lower end of the external surface of the vertical wall, contrasted by an idle wheel, with the curved sheet and the vertical profiles being destined to perform a combined striking and guiding action in order to cause, in combination with the advancing of the transporter, a gradual oscillation in an upstream direction of the head cap.

* * * * *